US006002391A

United States Patent [19]

Ito

[11] Patent Number: 6,002,391

[45] Date of Patent: Dec. 14, 1999

[54] DISPLAY CONTROL DEVICE AND A METHOD FOR CONTROLLING DISPLAY

[75] Inventor: Shuhei Ito, Hamamatsu, Japan

[73] Assignee: Yamaha Corporation, Hamamatsu, Japan

[21] Appl. No.: 08/777,972

[22] Filed: Dec. 24, 1996

[30] Foreign Application Priority Data

Jan. 11, 1996 [JP] Japan ..... 8-020460

[51] Int. Cl.[6] ..... G09G 5/00

[52] U.S. Cl. ..... 345/204; 345/339; 345/28

[58] Field of Search ..... 345/113, 115, 345/340, 343–345, 339, 28, 204

[56] References Cited

U.S. PATENT DOCUMENTS 5,047,755 9/1991 Morita et al. ..... 345/28

5,216,413 6/1993 Seiler et al. ..... 345/340

*Primary Examiner*—Matthew Luu
*Assistant Examiner*—Thu Nguyen
*Attorney, Agent, or Firm*—Pillsbury Madison & Sutro LLP

[57] ABSTRACT

There is provided a display control device according to which video data for a plurality of windows to be displayed on a display screen is prestored in a video memory regardless of a display position of the video data in each of the windows and an effective zone of each of the windows in a display screen and a priority order of the respective windows are also prestored. With respect to each scanning position in the display screen, one of the windows which is of the highest priority order is selected from among the windows which are being scanned in accordance with an effective display zone and a priority order of each of the windows, and video data of the selected window is read from the video memory on the basis of relation between the display position and the storage position of the video data.

4 Claims, 4 Drawing Sheets

DISPLAY CONTROL DEVICE AND A METHOD FOR CONTROLLING DISPLAY

BACKGROUND OF THE INVENTION

This invention relates to a display control device and a display control method for displaying a plurality of pictures with one picture being superposed on another on a display screen and, more particularly, to a device and a method of this type suitable for displaying a number of pictures without increasing an amount of transfer of data to be displayed.

In consumer type display control devices such as one for a game machine, a picture to be displayed is divided into parts and these parts are allocated to different display positions on a display screen and depth of the picture to be displayed is expressed by controlling the amount of scroll for each part and a priority order of superposed parts. For example, parts such as "clouds in the sky", "a mountain in the distance", "a road extending laterally in the picture and buildings along the road" and "an automobile running on the road" are allocated to different display positions. A part existing in the distance is given a lower priority order and a smaller amount of scroll than a part existing in a near position whereby depth in the whole picture can be expressed.

In this type of display control device, it is desirable to set a very fine priority order for respective parts each having a very narrow display zone allocated in the display screen. For this purpose, a prior art display control device adopts a system in which video data for all parts of a picture is transferred from a video memory and the picture to be displayed is reconstructed in accordance with a priority number attached to the respective video data. This system has the advantage that, since a preferential processing is performed after video data has been transferred from a frame buffer, the priority order can be controlled dot by dot by setting, for example, a color code of transparent display (i.e., displaying video data of a part having a lower priority order).

On the other hand, a video accelerator adapted for WINDOWS (trademark of Microsoft Inc.) which is used as a current main personal computer operating system adopts a system in which, in a case where display zones of windows set for respective applications overlap each other, video data of the overlapping display zones is rewritten to shift a lower window to the highest priority and superposition of windows can thereby be realized with only a single video data stored in the video memory. In this system, however, the video memory must be rewritten each time shifting of a window takes place so that there arises the problem that a smooth shifting of a window in real time cannot be made. In this system, therefore, a window frame only is written during shifting of a window for reducing the amount of data to be written and video data in the window is written after the location of the shifted window has been established.

In the former prior art display control device, video data of all parts of a picture must be transferred and, for achieving this, data bus of a broad width must be employed or a high speed memory must be used for increasing the amount of data to be transferred. The increase in the data bus necessitates parallel connection of plural frame buffers resulting in increase in the number of pins provided in an interface with the display control device which increases the manufacturing cost of the device. In the latter prior art display control device, there frequently occurs a case where writing of video data cannot catch up with shifting of a window of a large display zone or quick shifting of a window.

It is, therefore, an object of the invention to provide a display control device which enables display of plural pictures on a display screen and a smooth shifting of windows without increasing the amount of transferred data.

SUMMARY OF THE INVENTION

For achieving the above object of the invention, a display control device comprises a video memory storing video data for a plurality of pictures, origin coordinate storage means for storing a position of origin of the respective pictures in a coordinate system of the video memory, picture effective signal generation means for storing an effective display zone of the respective pictures and generating, in synchronism with display scanning, a picture effective signal indicating that the effective display zone is being scanned, priority order storage means for storing a priority order in display among the pictures, preferential picture processing means for determining one of the pictures to be displayed on the basis of the picture effective signal from the picture effective signal generation means and the priority order stored in the priority order storage means, and address generation means for generating an address in the video memory corresponding to display coordinates of the picture which has been determined by the preferential picture processing means in accordance with the position of origin of said picture stored in the origin coordinate storage means.

In one aspect of the invention, said address generation means comprises a memory coordinate counter which generates coordinate values of the respective pictures in the video memory in synchronism with the display scanning starting from the position of origin of the picture stored in the origin coordinate storage means, and selection means for selecting coordinate values of the picture which have determined by the preferential picture processing means from among coordinate values of the respective pictures generated by the memory coordinate counter.

In another aspect of the invention, said picture effective signal generation means generates the picture effective signal on the basis of a scanning position in a display screen and a effective display zone of the respective pictures in the coordinate system of the display screen.

In another aspect of the invention, said address generation means comprises, selection means for selecting the position of origin of the picture which has been determined by the preferential picture processing means from among positions of origin of the respective pictures stored in the origin coordinate storage means, and addition means for adding a coordinate value of the scanning position in the coordinate system of the display screen to the position of origin of the picture determined by the selection means.

For achieving the object of the invention, there is also provided a method for controlling display comprising steps of storing video data for a plurality of windows to be displayed on a display screen in a video memory regardless of a display position of the video data in each of the windows and also storing an effective zone of each of the windows in a display screen and a priority order of the respective windows, selecting, with respect to each scanning position in the display screen, one of the windows which is of the highest priority order from among the windows which are being scanned in accordance with an effective display zone and a priority order of each of the windows, and reading out video data of the selected window from the video memory on the basis of relation between the display position and the storage position of the video data.

According to the invention, effective zones in which respective windows which are expressed in a superimposed manner on a display screen exist and a priority order of display are stored in storage means such as a register. In synchronism with scanning of the display screen, a window to be displayed in respective display positions is selected in accordance with its effective zone and its priority order and which of video data of respective windows prestored in a video memory should be read out is thereby determined. Thus, when a picture displayed on the display screen changes, video data stored in the video memory need not be rewritten and a desired picture can be constructed on the display screen by properly determining the readout address.

Since, according to the invention, video data to be displayed at each display position only is selected and read out of the video memory from among video data for plural pictures, video data read out during scanning of one picture is only data for one picture. Accordingly, the amount of data t be transferred does not increase at all even if the number of pictures to be displayed increases. Besides, shifting of a window can be realized by simply changing the effective zone of the window stored in the register and shifting of a window in the direction of depth in the display screen can be realized by simply changing the priority order of display of the windows stored in the register.

The relation between the display position and the storage position can be readily obtained by, for example, storing the origin coordinates in the coordinate system of the video memory in the origin coordinate storage means. On the other hand, if respective windows are defined as effective display zones in respective pictures, a picture effective signal indicating that an effective display zone is being scanned is generated in synchronism with the display scanning and a picture of the highest priority in pictures in which this picture effective signal is active is selected. The address for video data to be read from the video memory is generated on the basis of the selected picture and its origin coordinates. Video data necessary for constructing a desired picture is thereby sequentially read from the video memory in synchronism with the display scanning.

The readout address of the video memory may be generated by, for example, using memory coordinate counters having origin coordinates of respective pictures as preset values and counting up these memory coordinate counters in synchronism with the display scanning.

Since scanned coordinates are relative coordinate values with respect to a display origin, memory coordinates may be obtained by adding coordinates of scanning positions on the display screen to the origin coordinates. This system is advantageous in that memory coordinate counters can be obviated.

The effective display zone can be defined either by the coordinates of the display screen or the coordinates of the video memory. In the former case, the picture effective signal is generated on the basis of a scanned coordinate value on the display screen whereas in the latter case, the picture effective signal is generated on the basis of a scanned coordinate value of each picture in the video memory.

BRIEF DESCRIPTION OF THE DRAWINGS

In the accompanying drawings.

DESCRIPTION OF PREFERRED EMBODIMENTS

Figure 1:
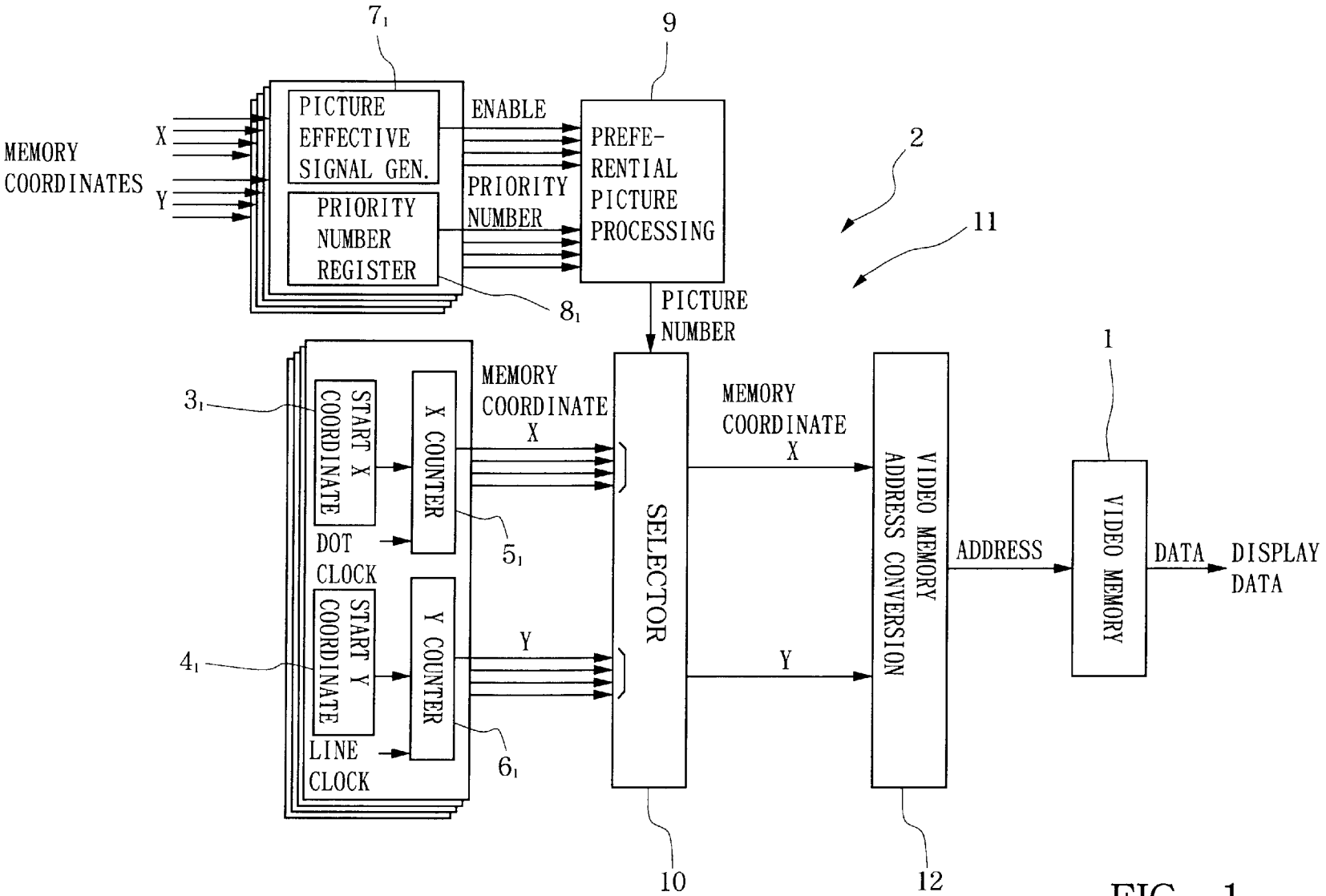
FIG. 1 is a block diagram showing an embodiment of the display control device made according to the invention.

FIG. 1 shows a prior art embodiment of the display control device.

This display control device includes a video memory 1 storing video data for plural pictures and a memory address generation section 2 which determines an address for reading out video data to be displayed at each coordinate position on a display screen from the video memory 1.

The memory address generation section 2 has a function of determining, with respect to each coordinates on the display screen, a memory address on the basis of an effective display zone in each picture, a priority order of display between respective pictures and a position of origin of each picture in the coordinate area of video memory 1.

Figure 2A:
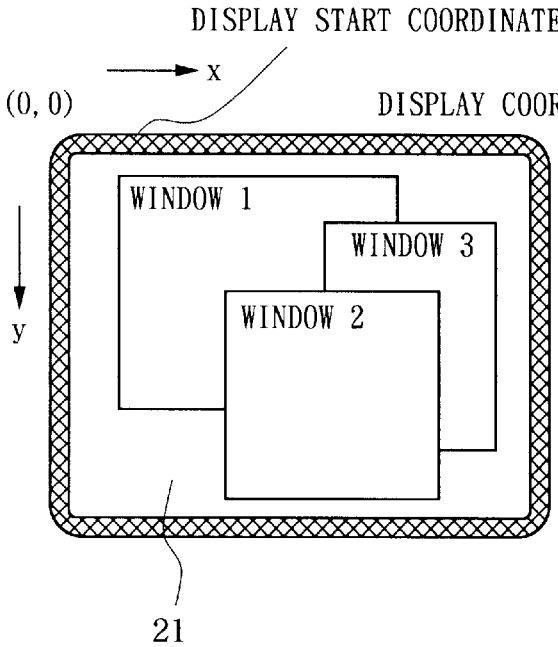
FIGS. 2A and 2B are diagrams showing an example of picture displayed by the device of this embodiment.

Referring to FIG. 2A, in a display screen 21, there is established an orthogonal coordinate system in which an origin (0, 0) is located at the left upper corner and the X axis extends in the horizontal direction and the Y axis extends in the vertical direction. The display scanning based on a dot clock and a line clock is performed with its main scanning direction extending in the horizontal direction and its subscanning direction extending in the vertical direction and starts from the origin (0, 0) which constitutes display start coordinates.

In this display coordinate area, a background picture and plural windows (WINDOW1 to WINDOW3) are displayed. A priority order is established among the background picture and the respective windows in the order of WINDOW2>WINDOW3>WINDOW1>background picture and the respective pictures are displayed in a superposed manner on the basis of this priority order.

Video data of the WINDOW1–WINDOW3 and the background picture are stored in different areas in the video memory 1 in a manner not to overlap one another.

Figure 3:
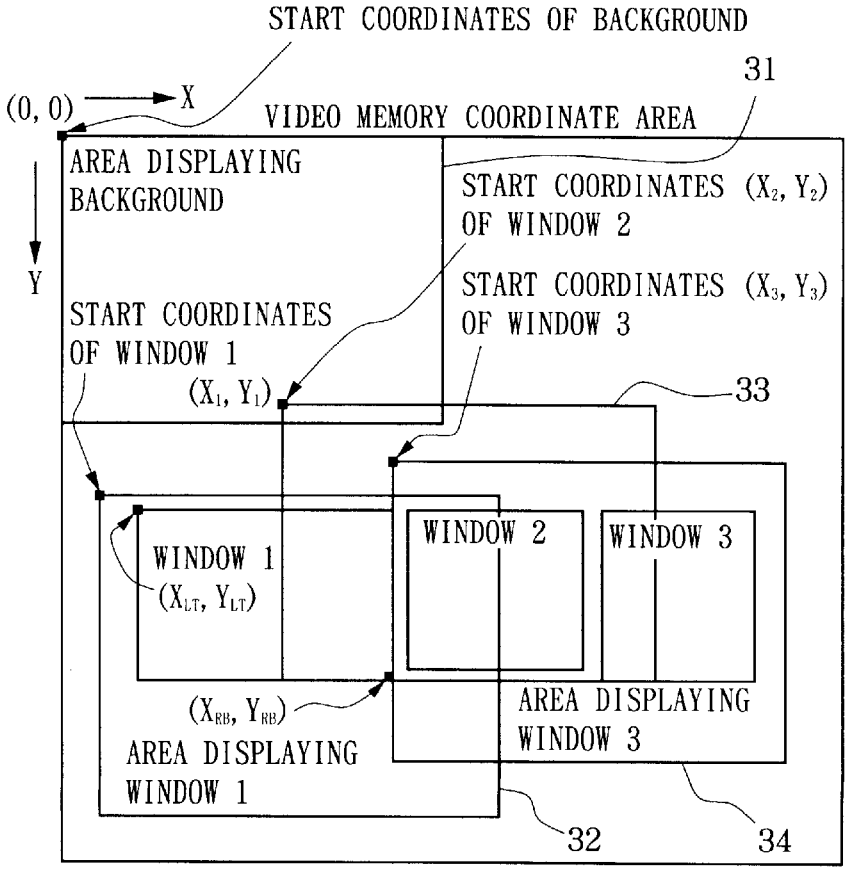
FIG. 3 is a diagram showing an example of video data stored in a video memory of this embodiment.

More specifically, in the video memory 1, as shown in FIG. 3, there is established an orthogonal coordinate system having its origin (0, 0) at the left upper corner and the X axis extending in the horizontal direction and the Y axis extending in the vertical direction. In this video memory coordinate area, for example, a background picture area 31, picture areas 32, 33 and 34 for the WINDOW1 to WINDOW3 are established. Start coordinates (origin coordinates) (0, 0), (X1, Y1), (X2, Y2) and (X3, Y3) of the picture areas 31–34 correspond to the positions of origin of displayed pictures when the picture areas 31–34 are displayed on the display screen.

The start coordinates (0, 0), (X1, Y1), . . . of the picture areas 31–34 are stored in start X coordinate registers $\mathbf{3}_1$, $\mathbf{3}_2$, . . . and start Y coordinate registers $\mathbf{4}_1$, $\mathbf{4}_2$, . . . in FIG. 1.

Memory X coordinate counters $\mathbf{5}_1$, $\mathbf{5}_2$, . . . and memory Y coordinate counters $\mathbf{6}_1$, $\mathbf{6}_2$, . . . generate memory coordinates (X, Y) of the respective pictures in the video memory 1 on the basis of the start coordinates (X1, Y1), (X2, Y2), . . . of the respective pictures held in the start X coordinate registers $\mathbf{3}_1$, $\mathbf{3}_2$, . . . and the start Y coordinate registers $\mathbf{4}_1$, $\mathbf{4}_2$, . . . in synchronism with the display scanning. More specifically, the memory X coordinate counters $\mathbf{5}_1$, $\mathbf{5}_2$, . . . count up at each dot clock in synchronism with the display scanning and loads the start X coordinates X1, X2, . . . each time the scanning line changes. The memory Y coordinate counters $6_1$, $6_2$, . . . count up at each line clock and loads the start Y coordinates Y1, Y2, . . . upon completion of counting of one field.

Picture effective signal generation circuits $7_1$, $7_2$, . . . store effective display zones of the picture areas 31–34 displaying the WINDOW1–WINDOW3 and the background picture and generate, in synchronism with the display scanning, enable signals which indicate that inside areas of the WINDOW1–WINDOW3 and the background picture are being scanned. More specifically, the picture effective signal generation circuits $7_1$, $7_2$, . . . store areas of the WINDOW1–WINDOW3 and the background picture on the basis of memory coordinates ($X_{LT}$, $Y_{LT}$) at the left upper corner of these areas and memory coordinates ($X_{RB}$, $Y_{RB}$) at the right lower corner of these areas and, by comparing these data in magnitude with the memory coordinates (X, Y) produced by the memory X coordinate counters and memory Y coordinate counters, determine whether or not the generated memory coordinates (X, Y) are within the WINDOW1–WINDOW3 or the background picture.

Priority number registers $8_1$, $8_2$, . . . store the priority order of display among the respective pictures in the form of priority numbers "1", "2", . . . . When the priority numbers "1", "2", . . . are established in the order of the WINDOW2, WINDOw3 and WINDOW1, the display screen shown in FIG. 2A can be obtained. The background picture is always imparted with the lowest priority order.

A preferential picture processing circuit 9 determines, in synchronism with the display scanning, a picture to be displayed on the basis of the enable signals from the picture effective signal generation circuits $7_1$, $7_2$, . . . and the priority numbers stored in the priority number registers $8_1$, $8_2$, . . . . More specifically, the preferential picture processing circuit 9 receives from the priority number registers $8_1$, $8_2$, . . . the priority numbers "1", "2", . . . of the respective pictures in which the enable signals supplied from the picture effective signal generation circuits $7_1$, $7_2$, . . . and compares these values and outputs the picture numbers "1", "2", . . . which is of the highest priority order among the pictures in which the enable signal is "1".

A selector 10 selects the memory coordinates (X, Y) of the picture which has been determined by the preferential picture processing circuit 9 from among the memory coordinates (X, Y) of the respective pictures generated by the memory X coordinate counters $5_1$, $5_2$, . . . and the memory Y coordinate counters $6_1$, $6_2$, . . . and supplies the selected coordinates to a video memory address conversion circuit 12. The memory X coordinate counters $5_1$, $5_2$, . . . and the memory Y coordinate counters $6_1$, $6_2$, . . . and the selector 10 constitute the address generation section 11.

The video memory address conversion circuit 12 converts the memory coordinates (X, Y) supplied from the selector 10 to an address for the video memory 1. Video data read from the video memory 1 by the address set by the video memory address conversion circuit 12 is supplied to a video controller (not shown) where the video data is converted to an RGB signal and also supplied to a display such as a monitor.

The operation of this display control device will now be described.

Figure 2B:
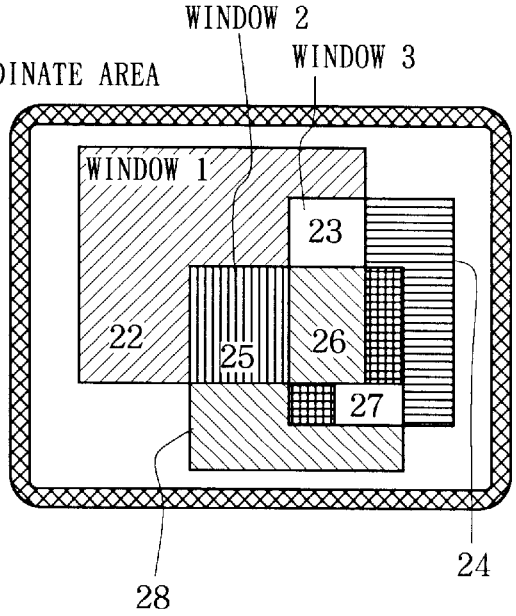

Upon starting of scanning from the display start coordinates (0, 0) of FIG. 2A, the enable signal supplied from the picture effective signal generation circuit $7_1$ for the background picture only is turned to "1" and, therefore, the coordinates (X, Y) of the picture area for displaying the background are selected. As the display scanning has reached a display area 22 for the WINDOW1 as shown in FIG. 2B, the enable signal supplied from the picture effective signal generation circuit $7_2$ is also turned to "1". Since the WINDOW1 is of a higher priority than the background picture, the memory coordinates (X, Y) of the WINDOW1 are now selected. As the display scanning has reached a display area 23 for the WINDOW3, the enable signals supplied from the picture effective signal generation circuits $7_1$, $7_2$ and $7_4$ are turned to "1" and, therefore, the priority numbers "4", "3" and "2" are compared and the memory coordinates (X, Y) of the WINDOW3 which is of the highest priority are selected. As the display scanning has reached a display area 24 for the WINDOW3, the enable signals supplied from the picture effective signal generation circuits $7_1$ and $7_4$ are turned to "1" and, therefore, the priority numbers "4" and "2" are compared and the memory coordinates (X, Y) of the WINDOW3 which is of a higher priority are selected. As the display scanning has reached a display area 25 for the WINDOW2, the enable signals supplied from the picture effective signal generation circuits $7_1$ to $7_3$ are turned to "1" and, therefore, the priority numbers "4", "3" and "1" are compared and the memory coordinates (X, Y) of the WINDOW2 which is of the highest priority are selected. As the display scanning has reached a display area 26 for the WINDOW3, the enable signals supplied from the picture effective signal generation circuits $7_1$ to $7_4$ are turned to "1" and, therefore, the priority numbers "4", "3", "1" and "2" are compared and the memory coordinates (X, Y) of the WINDOW2 which is of the highest priority are selected. As the display scanning has reached a display area 27 for the WINDOW3, the enable signals supplied from the picture effective signal generation circuits $7_1$, $7_3$ and $7_4$ are turned to "1" and, therefore, the priority numbers "4", "1" and "2" are compared and the memory coordinates (X, Y) of the WINDOW2 which is of the highest priority are selected. As the display scanning has reached a display area 28 for the WINDOW2, the enable signals supplied from the picture effective signal generation circuits $7_1$ and $7_3$ are turned to "1" and, therefore, the priority numbers "4" and "2" are compared and the memory coordinates (X, Y) of the WINDOW2 which is of the highest priority are selected.

According to this embodiment, since the preferential processing is performed in the stage of generating addresses for the video memory 1, access to the video memory 1 can be always held to one picture only regardless of the number of the superposed WINDOW1 to WINDOW3. Further, in the case of shifting the display area of the WINDOW1–WINDOW3, it suffices to load a value which has increased by the amount of shifting in the start X coordinate registers $3_1$, $3_2$, . . . and the start Y coordinate registers $4_1$, $4_2$, . . . . By this arrangement, the WINDOW1–WINDOW3 can be shifted without rewriting the shifting WINDOW1–WINDOW3 in the video memory 1. Furthermore, in a case where the WINDOW1–WINDOW3 are to be shifted backwardly, it will suffice to change the priority number set for the WINDOW1–WINDOW3 for shifting them. Accordingly, even in a case where a window of a large display area is shifted or where a window is shifted promptly, pictures can be smoothly shifted without delay.

Figure 4:
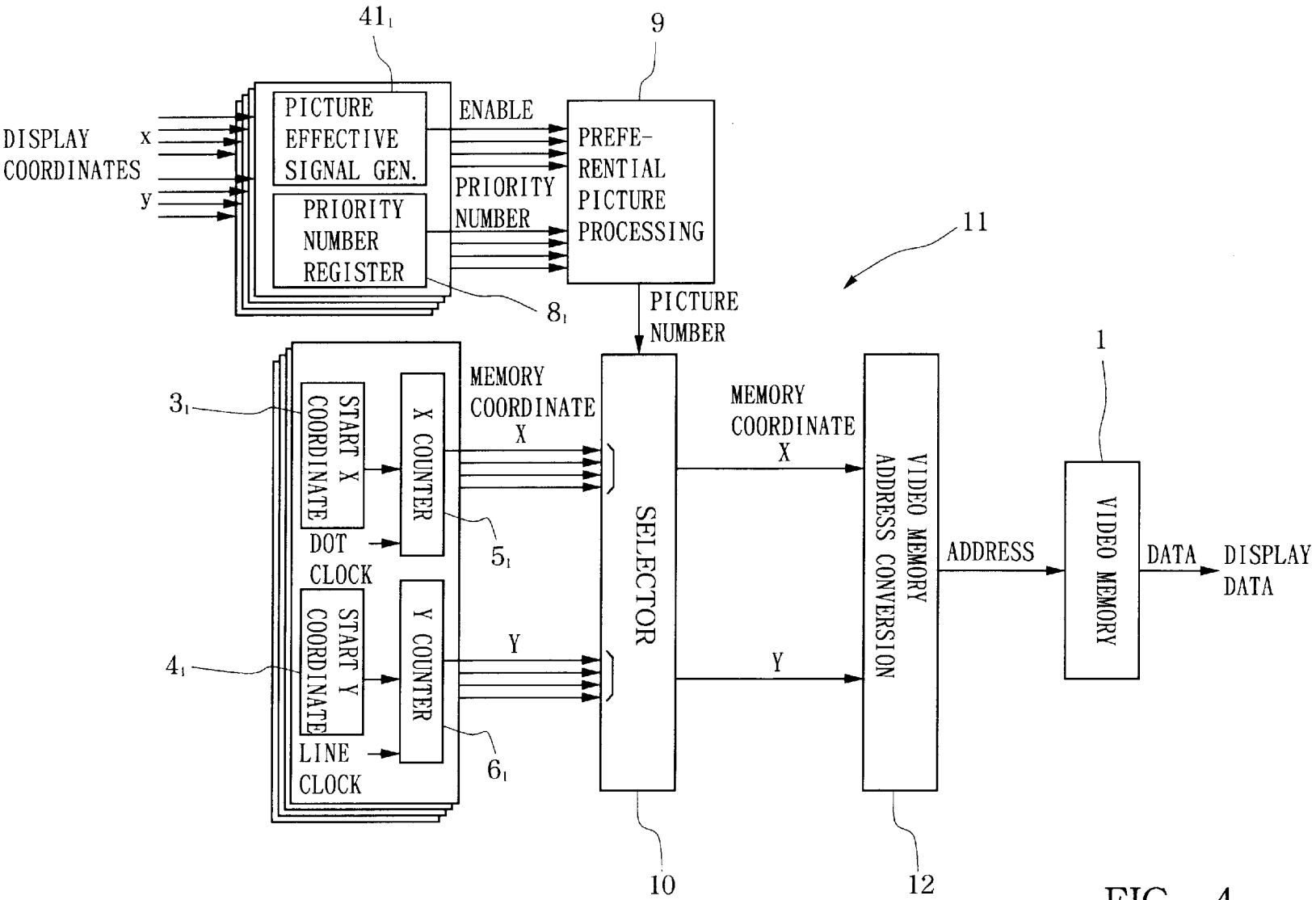
FIG. 4 is a block diagram showing another embodiment of the display control device.

FIG. 4 shows another prior art embodiment of the display control device.

In this embodiment, picture effective signal generation circuits $41_1$, $41_2$, . . . store effective display zones of WINDOW1–WINDOW3 in the form of a display coordinate system. According to this embodiment, the display coordinate system is used as the base of the device and, therefore, common display coordinate values x, y supplied to the picture effective signal generation circuits can be used for the respective pictures so that input lines of the circuit can be simplified as compared with the first described embodiment.

Figure 5:
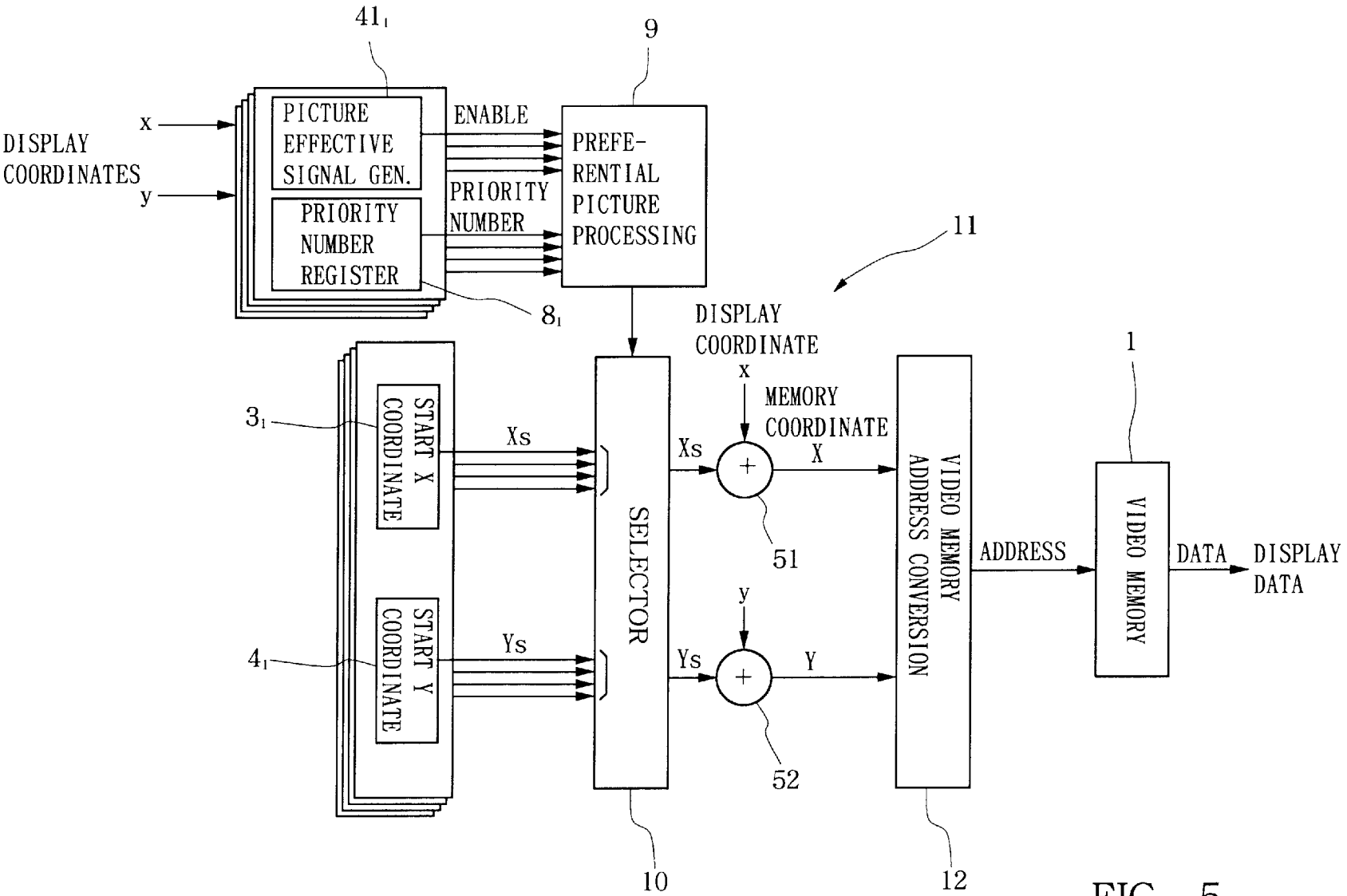
FIG. 5 is a block diagram showing another embodiment of the display control device.

FIG. 5 shows the preferred embodiment of the display control device according to the invention.

In this embodiment, the address generation section 11 consists of a selector 10, an X coordinate adder 51 and a Y coordinate adder 52. The selector 10 selects start coordinates ($X_S$, $Y_S$) which have been determined by the preferential picture processing circuit 9 from among start coordinates $X_S$, $Y_S$ of respective pictures stored in the start X coordinate registers $\mathbf{3}_1$, $\mathbf{3}_2$, . . . and the start Y coordinate registers $\mathbf{4}_1$, $\mathbf{4}_2$, . . . . The start coordinates ($X_S$, $Y_S$) are added to the display coordinates (x, y) by the X coordinate adder 51 and the Y coordinate adder 52 in synchronism with the display scanning and the results of the addition are provided as memory coordinates (X, Y). This embodiment is advantageous in that the memory X coordinate counters $\mathbf{5}_1$, $\mathbf{5}_2$, . . . and the memory Y coordinate counters $\mathbf{6}_1$, $\mathbf{6}_2$, . . . can be obviated.

As described in the foregoing, according to the invention, it is sufficient to read out video data for only one picture and, therefore, the amount of transferred data does not increase despite increase in the number of displayed pictures. Besides, shifting of windows is realized by simply changing the effective display zone of the windows stored in the registers and shifting of the windows in the direction of depth is realized by simply changing the priority order of display among the windows stored in the registers.

What is claimed is:

1. A display control device comprising:

a video memory for storing video data representative of a plurality of pictures;

an origin coordinate memory for storing a position of origin for each of the plurality of pictures in a coordinate system of the video memory;

a picture effective signal generation circuit for storing data representative of an effective display zone of each of the plurality of pictures and generating, in synchronism with display scanning, a picture effective signal indicating that the effective display zone is being scanned;

a memory for storing data representative of a priority display order for the plurality of pictures;

a preferential picture processing circuit for selecting a picture from one of the plurality of pictures to be displayed on the basis of the picture effective signal from the picture effective signal generation circuit and the priority display order; and a circuit for generating an address in the video memory corresponding to display coordinates of the picture selected by the preferential picture processing circuit in accordance with the position of the origin of the picture stored in the origin coordinate memory, wherein the circuit for generating an address further includes, a circuit for selecting the position of the origin of the picture selected by the preferential picture processing circuit from among positions of origin of the plurality of pictures stored in the origin coordinate memory, and a circuit for adding a coordinate value of the scanning position in the coordinate system of the display screen to the position of the origin of the picture selected by the circuit for selecting the position of the origin.

2. A display control device as defined in claim 1 wherein said picture effective signal generation means generates the picture effective signal on the basis of a scanning position in a display screen and the effective display zone of the respective pictures in the coordinate system of the display screen.

3. A method of controlling a display, the method comprising:

storing video data for each of a plurality of windows to be displayed on a display screen in a video memory independent of any display position of the video data in each of the windows;

storing data representative of a position of origin of each of the plurality of windows in the video memory;

storing data representative of a picture effective display zone of each of the plurality of windows in the display screen;

generating, in synchronism with display scanning, a picture effective signal indicating that the picture effective display zone is being scanned;

storing a priority display order for the plurality of windows;

selecting a window from the plurality of windows to be displayed on the basis of the picture effective signal and the priority display order;

generating an address in the video memory corresponding to display coordinates of the selected window including the position of the origin of the selected window, by selecting the position of the origin of the selected window from among positions of origin of the plurality of windows, and adding a coordinate value of a display scanning position in the coordinate system of the display screen to the position of the origin of the selected window; and retrieving video data associated with the selected window from the video memory based on the generated address.

4. A method of controlling a display according to claim 3, wherein the step of generating the picture effective signal is based on a scanning position in the display screen and the picture effective display zone of each of the plurality of pictures in the coordinate system of the display screen.

* * * * *